US010510472B2

(12) United States Patent
Pessina et al.

(10) Patent No.: US 10,510,472 B2
(45) Date of Patent: Dec. 17, 2019

(54) COIL ACTUATOR FOR LV OR MV APPLICATIONS

(71) Applicant: ABB S.p.A, Milan (IT)

(72) Inventors: Davide Pessina, Monza (IT); Mauro Ghislotti, Bergamo (IT)

(73) Assignee: ABB S.p.A., Milan (IT)

( * ) Notice: Subject to any disclaimer, the term of this patent is extended or adjusted under 35 U.S.C. 154(b) by 408 days.

(21) Appl. No.: 15/456,546

(22) Filed: Mar. 12, 2017

(65) Prior Publication Data

US 2017/0263364 A1 Sep. 14, 2017

(30) Foreign Application Priority Data

Mar. 14, 2016 (EP) ..... 16160095

(51) Int. Cl.
*H01F 7/06* (2006.01)

(52) U.S. Cl.
CPC ..... *H01F 7/064* (2013.01)

(58) Field of Classification Search
CPC ..... H01F 7/064; H01F 7/1844; H01H 47/325; H01H 47/002; H01H 83/12
USPC ..... 361/187
See application file for complete search history.

(56) References Cited

FOREIGN PATENT DOCUMENTS

| | | |
|---|---|---|
| EP | 1150411 | 10/2001 |
| EP | 2149890 | 2/2010 |
| EP | 2579291 | 4/2013 |
| EP | 2983187 | 2/2016 |
| WO | 9740509 | 10/1997 |

OTHER PUBLICATIONS

Yves; Inductive Charge Control Device; Publication Date; Oct. 30, 1997; (Year: 1997).*
European Search Report Application Serial No. EP16160095 completed Oct. 13, 2016, 8 pages.

* cited by examiner

*Primary Examiner* — Dharti H Patel
(74) *Attorney, Agent, or Firm* — J. Bruce Schelkopf; Taft Stettinius & Hollister LLP

(57) ABSTRACT

The present application relates to a coil actuator for low and medium voltage applications, which comprises a electromagnet operatively associated with a movable plunger, a power & control unit electrically connected with the electromagnet and first and second input terminals (T1, T2) operatively connected with the power & control unit, wherein an input voltage (VIN) is applied between said first and second input terminals during the operation of the coil actuator. The coil actuator further comprise a third input terminal (T3) operatively connected with the power & control unit, the third input, terminal being adapted to be in a first operating connection (A), which correspondences to normal control conditions (NDC) for the operation of the electromagnet, or in a second operating condition (B), which corresponds to overriding control conditions (ODC) for the operation of said electromagnet. The power & control unit is adapted to control the operation of the electromagnet according to the normal control conditions or the overriding control conditions depending on the operating condition (A, B) of the third input terminal.

20 Claims, 13 Drawing Sheets

COIL ACTUATOR FOR LV OR MV APPLICATIONS

The present invention relates to a coil actuator for low or medium voltage applications, which has improved features in terms of performances and construction.

For the purposes of the present application, the term "low voltage" (LV) relates to operating voltages lower than 1 kV AC and 1.5 kV DC whereas the term "medium voltage" (MV) relates to operating voltages higher than 1 kV AC and 1.5 kV DC up to some tens of kV, e.g. up to 72 kV AC and 100 kV DC.

As is widely known, coil actuators are frequently used in MV and LV installations for a wide variety of purposes.

A typical use of coil actuators relates to the selective release or lock of mechanical parts in a spring-actuated switching apparatus.

Other typical uses may relate to the implementation of electrically commanded locking or tripping functionalities in mechanical kinematic chains or actuators.

Coil actuators normally comprise an electronics receiving an input voltage and driving, depending on said input voltage, an electromagnet, which includes one or more actuating coils operatively associated with a movable plunger in such a way that this latter can be magnetically actuated by a magnetic field generated by currents flowing along said one or more actuating coils.

Coil actuators have shown relevant advantageous aspects that have made their usage quite popular in LV or MV applications.

However, it is quite felt in the market the need for solutions ensuring a more flexible operation for these devices and, at the same time, reliable performances for the intended applications.

In order to respond to this need, the present invention provides a coil actuator, according to the following claim 1 and the related dependent claims.

The coil actuator, according to the invention, comprises an electromagnet operatively associated with a movable plunger in such a way that said movable plunger can be actuated by a magnetic field generated by said electromagnet.

The coil actuator, according to the invention, comprises also a power & control unit electrically connected with said electromagnet to feed said electromagnet and to control the operation of said electromagnet.

The coil actuator, according to the invention, further comprises first and second input terminals electrically connected with said power & control unit.

During the operation of said coil actuator, an input voltage, which may be provided by an external device (e.g. a relay), is applied between said first and second terminals.

The coil actuator, according to the invention, comprises a third input terminal electrically connected with said power & control unit.

Said third input terminal is adapted to operate in a first operating condition, which corresponds to normal control conditions for the operation of said electromagnet, or in a second operating condition, which corresponds to overriding control conditions for the operation of said electromagnet.

Said power & control until is adapted to control the operation of said electromagnet according to said normal control conditions or according to said overriding control conditions depending on the operating condition of said third input terminal.

Preferably, said power & control unit is adapted to control the operation of said electromagnet depending on the input voltage applied between said first and second terminals, when said third input terminal is in said first operating condition.

Preferably, said power & control unit is adapted to control the operation of said electromagnet independently from the input voltage applied between said first and second terminals, when said third input terminal is in said second operating condition.

Preferably, said power & control unit is adapted to provide no drive currents to said electromagnet, when said third input terminal is in said second operating condition, independently from the input voltage applied at said first and second terminals.

In a further aspect, the present invention relates to a LV or MV switching apparatus or switchgear according to the following claim 13.

Further characteristics and advantages of the present invention will emerge more clearly from the description given below, referring to the attached figures, which are given as a non-limiting example, wherein.

Figure 1:
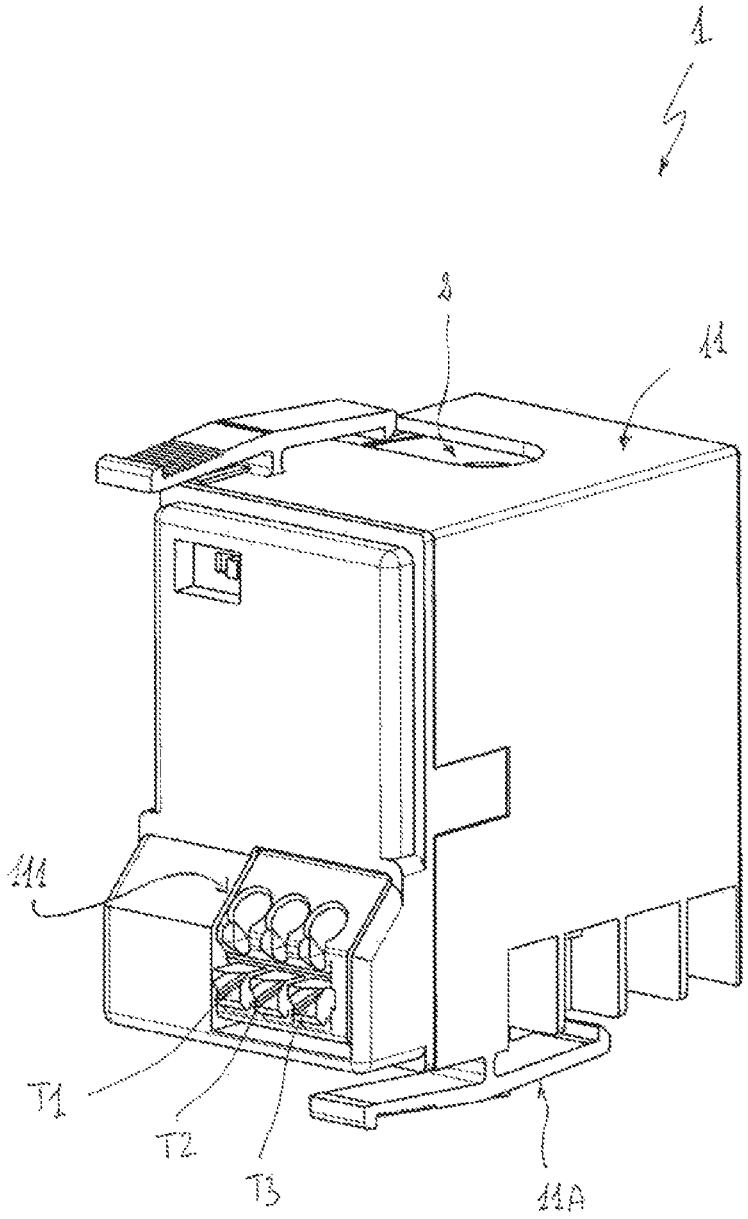
FIGS. 1, 2, 3 illustrate schematic views of an embodiment of the coil actuator, according to the invention.
Figure 2:
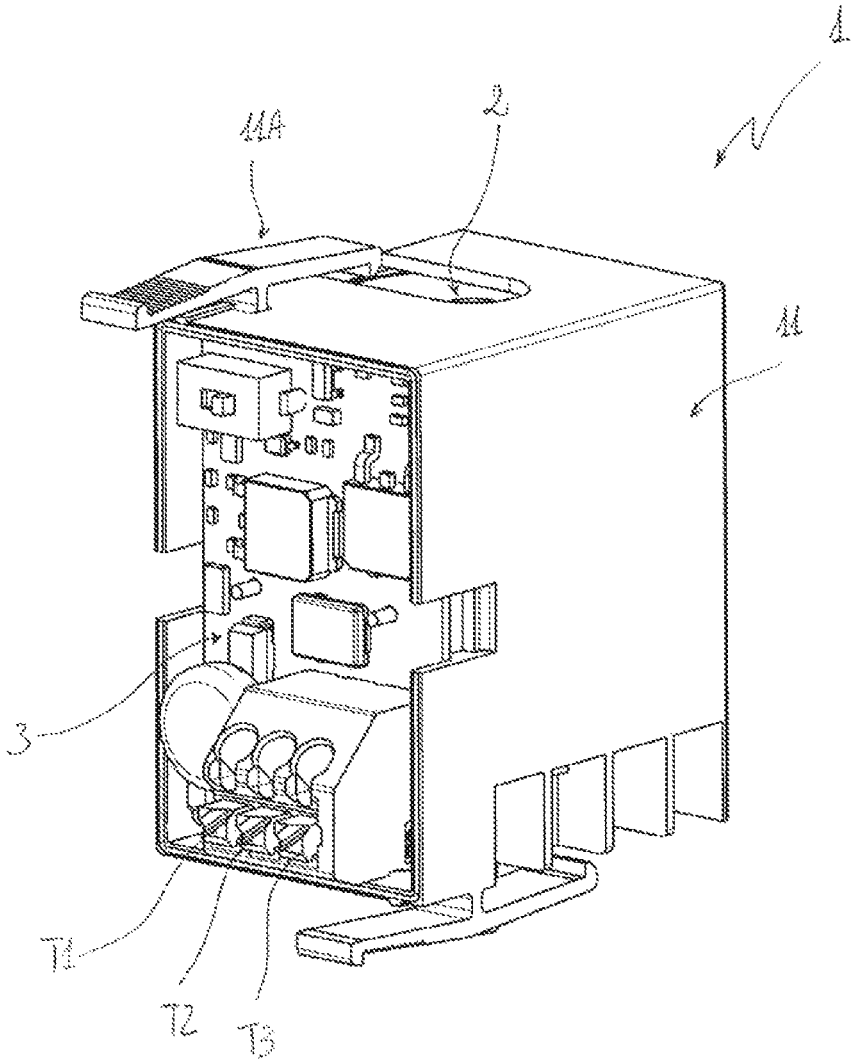
Figure 3:
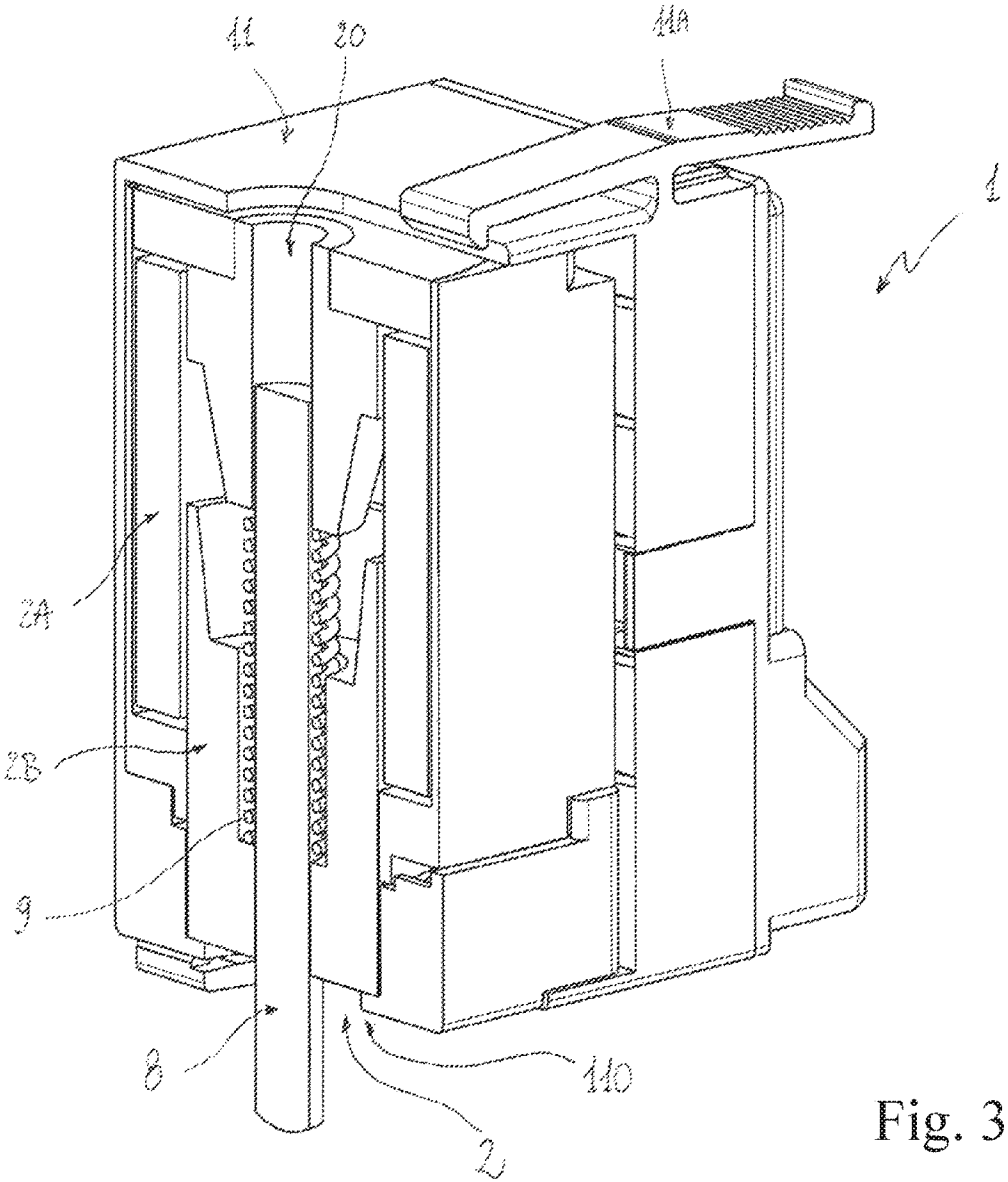

FIGS. 6, 7, 7A, 7B schematically illustrate the operation of the coil actuator of FIGS. 1-3.

In the following detailed description of the invention, identical components are generally indicated by same reference numerals, regardless of whether they are shown in different embodiments. In order to clearly and concisely disclose the invention, the drawings may not necessarily be to scale and certain features of the invention may be shown in a schematic form.

With reference to the above-mentioned figures, the present invention concerns a coil actuator 1 for LV or MV applications such as, for example, LV or MV switching apparatuses (e.g. circuit breakers, disconnectors, contactors, and the like) or, more generally, LV or MV switchgears.

The coil actuator 1 comprises an outer casing 11 defining an internal volume and preferably made of an electrically insulating material (e.g. thermosetting resins).

Preferably, the outer casing 11 is provided with external flexible connection wings 11A adapted to allow the installation of the coil actuator on a supporting structure (not shown).

Preferably, the outer casing 11 is provided with a first opening 111 (FIG. 1), at which input terminals T1, T2, T3 of the coil actuator 1 may be accessed.

The coil actuator 1 comprises an electromagnet 2 stably accommodated in the internal volume defined by the outer casing 11.

Preferably, the electromagnet 2 comprises at least an actuation coil 2A advantageously arranged according to a solenoid construction.

The actuation coil 2A is intended to be powered by an adjustable drive current IC to generate a magnetic field having a desired direction and intensity.

Preferably, the coil actuator 1 is of the single-coil type. In this case, the electromagnet 2 comprises a single actuation coil 2A.

Preferably, the electromagnet 2 comprises one or more portions 2B of magnetic material, to properly direct the lines of the magnetic field generated by a drive current IC energizing the electromagnet 2.

Preferably, the electromagnet 2 comprises an internal cavity 20 (e.g. having a cylindrical shape) surrounded by the actuation coil 2A and the portions 2B of magnetic material of the coil electromagnet 2.

The coil actuator 1 comprises a movable plunger 8 operatively associated to the electromagnet 2 such that it can be actuated by a magnetic field generated by a drive current IC flowing along the actuation coil 2A.

Preferably, the plunger 8 is accommodated in the internal cavity 20 of the electromagnet 2, through which it can move.

In general, the plunger 8 is linearly movable between a non-excited position, which is taken when no drive currents IC are provided to the actuation coil 2A, and an excited position, which is taken when a drive current IC is provided to the actuation coil 2A.

Preferably, the coil actuator 1 comprises an elastic element 9 (e.g. a spring) operatively associated with the plunger 8.

Preferably, the elastic element 9 is operatively coupled between a fixed anchoring point and the plunger 8 in such a way to exert a biasing force on this latter. Said biasing force may be advantageously used to actuate the plunger 8 when a drive current IC powering the actuation coil 2A is interrupted.

Preferably, the outer casing 11 is provided with a second opening 110 (FIG. 3) that allows the plunger 8 to protrude from the casing 11 and interface with a mechanism 200 of a switching apparatus or switchgear, with which the coil actuator 1 is intended to interact.

As an example, the mechanism 200 may be the primary command chain of a LV circuit breaker.

The coil actuator 1 comprises a power & control unit 3 electrically connected with the electromagnet 2, in particular with the actuation coil 2A of this latter.

Preferably, the power & control unit 3 is constituted by one or more electronic boards accommodated in the internal volume defined by the outer casing 11 and comprising analog and/or digital electronic circuits and/or processing devices.

The power & control unit 3 is configured to feed the electromagnet 2 and control the operation (energization) of this latter to properly actuate the movable plunger 8.

Preferably, in order to move the plunger 8 from the non-excited position to the excited position, the power & control unit 3 provides a drive current IC to the electromagnet 2 (in particular to the actuation coil 2A) so that the plunger 8 is actuated by the force of the magnetic field generated by said drive current, against the biasing force exerted by the elastic element 9.

Preferably, in order to move the plunger 8 from the excited position to the non-excited position, the power & control unit 3 interrupts the drive current IC flowing to the actuation coil 2A so that the plunger 8 is actuated by the biasing force exerted by the elastic element 9, as no magnetic fields are generated by the electromagnet 2.

The coil actuator 1 comprises first and second input terminals T1, T2 electrically connected with the power & control unit 3.

During the operation of the coil actuator 1, an input voltage VIN is applied between the input terminals T1, T2 and is thus provided to the power & control unit 3.

The voltage VIN is provided to the coil actuator 1 by an external device electrically connectable therewith, e.g. a relay or another protection device.

An important aspect of the present invention consists in that the coil actuator 1 comprises a third input terminal T3 electrically connected with the power & control unit 3.

The input terminal T3 is adapted to take different operating conditions corresponding to different control conditions adopted by the power & control unit 3 to control the operation of the electromagnet 2.

More particularly, the input terminal T3 is adapted to be in a first operating condition A or in a second operating position B, which respectively correspond to normal control conditions NDC or overriding control conditions ODC adopted by the power & control unit 3 to control the operation of the electromagnet 2.

The operating conditions A, B of the input terminal T3 basically depend on the electrical connectivity status of this latter.

Preferably, when it is in the first operating condition A, the input terminal T3 is electrically floating in such a way that no currents flow through it, whereas, when it is in the second operating condition B, the input terminal T3 is electrically connected to an electrical circuit, e.g. ground, a circuit operatively connected with the coil actuator or a circuit comprised in the coil actuator, and the like.

Preferably, when it is in the second operating condition B, the input terminal T3 is electrically coupled with one of the input terminals T1, T2.

Preferably, the reversible transition of the input terminal T3 between the operating conditions A, B is controlled by a control device 100 external to the coil actuator 1.

Preferably, the control device 100 is operatively coupled with the terminal T3 in such a way to be able to electrically couple or decouple the terminal T3, in a reversible way, with or from one of the input terminals T1, T2. As an example, the control device 100 may be constituted by a switch operable by a relay, a user or any actuating device.

In the cited figures, only by way of example, the input terminal T3 is shown as being electrically coupled with the input terminals T2, when it is in the second operating condition B.

It is however intended that, according to the needs, the input terminal T3 may be electrically coupled with the input terminals T1, when it is in the second operating condition B.

In AC applications (i.e. when the input voltage VIN is an AC voltage), the input terminal T3 may be electrically coupled with anyone of the input terminals T1-T2, when it is in the second operating condition B.

In DC applications (i.e. when the input voltage VIN is a DC voltage), the input terminal T3 is preferably coupled with the terminal T1 or T2 intended to be put at positive voltage, when it is in the second operating condition B.

However, in certain DC applications, the input terminal T3 may be coupled with the input terminal T1 or T2 intended to be grounded or put at negative voltage, when it is in the second operating condition B.

According to the invention, the power & control until 3 is adapted to control the operation of the electromagnet 2, in particular the energization of this latter by a drive current IC flowing through the actuation coil 2A, according to the normal control conditions NDC or the overriding control conditions ODC depending on the operating conditions A, B of the third input terminal T3.

Preferably, the power & control until 3 controls the operation of the electromagnet 2 according to the normal control conditions NDC when it controls the energization of said electromagnet depending on the input voltage VIN applied at the input terminals T1, T2.

Figure 7:
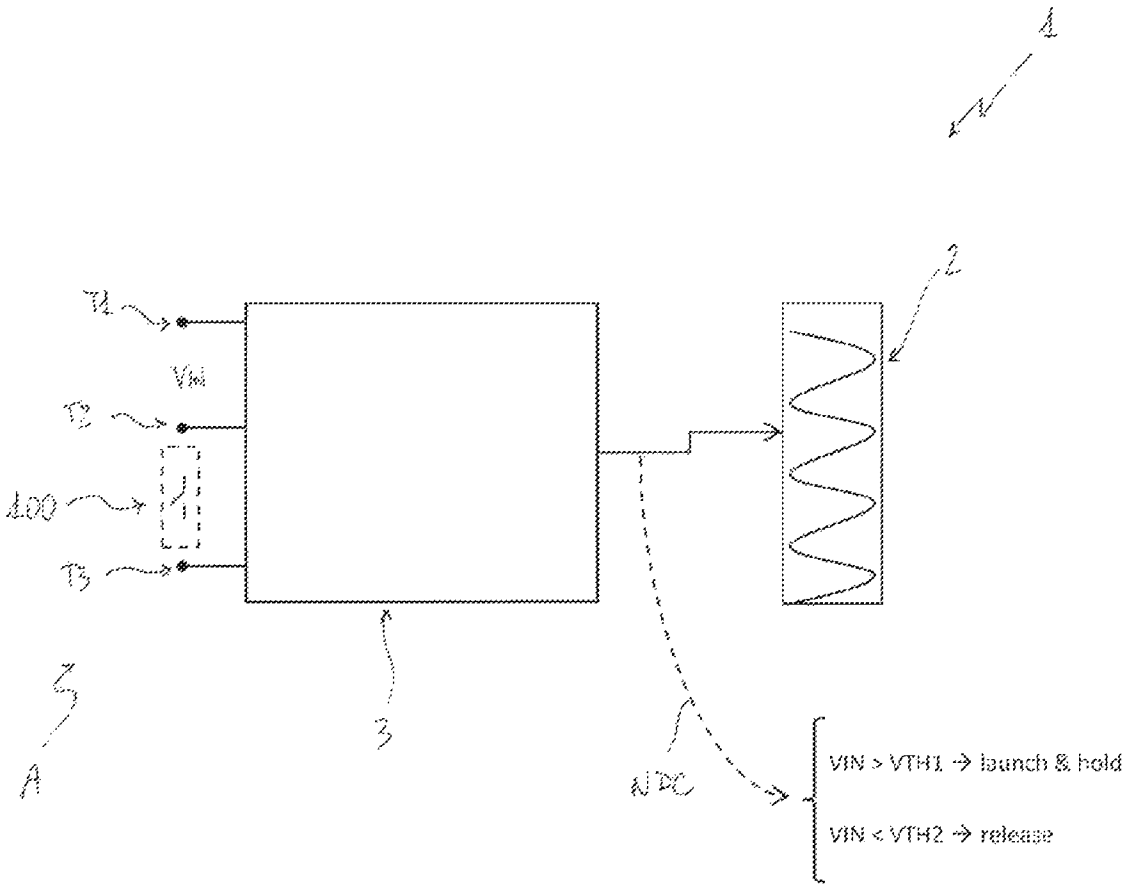
Figure 7A:
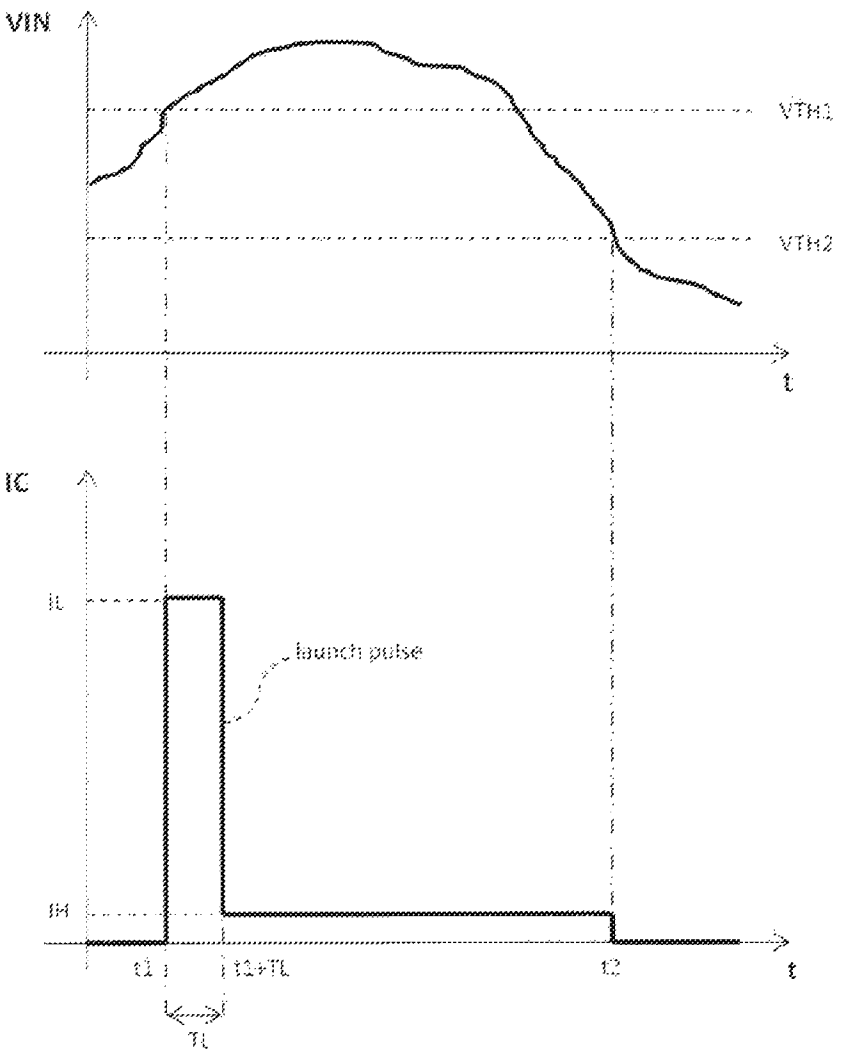
Figure 7B:
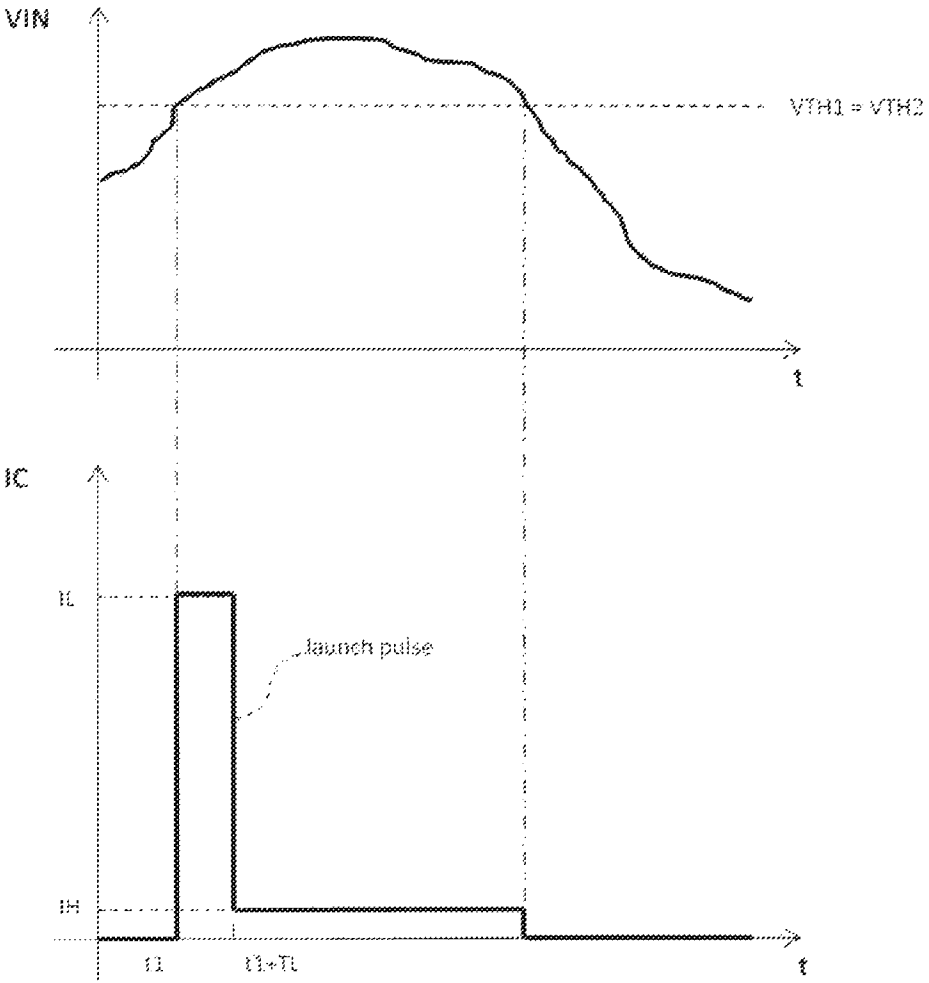

The power & control unit 3 is therefore adapted to provide and control the flow of a drive current IC to the electromagnet 2 depending on the input voltage VIN applied at the input terminals T1, T2, when the input terminal T3 is in the first operating condition A (FIGS. 7, 7A-7B).

Preferably, the power & control until 3 controls the operation of the electromagnet 2 according to the overriding control conditions ODC when it controls the energization of said electromagnet independently from the input voltage VIN applied at the input terminals T1, T2.

Figure 6:
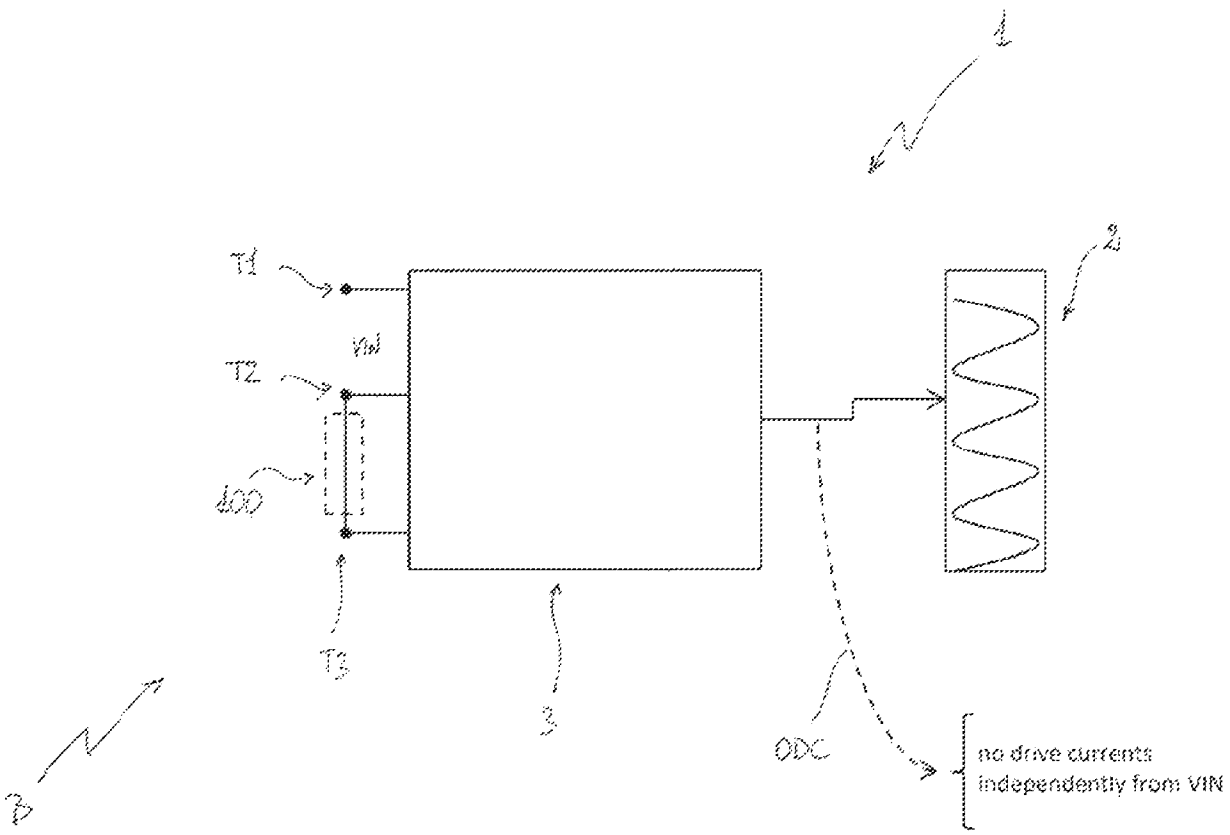

The power & control unit 3 is therefore adapted to provide and control the flow of a drive current IC to the electromagnet 2 independently from the input voltage VIN applied at the input terminals T1, T2, when the input terminal T3 is in the second operating condition B (FIG. 6).

According to an embodiment of the invention, which is shown in the cited figures, when the input terminal T3 is in the first operating condition A, the power & control unit drives the electromagnet 2 in such a way that the coil actuator 1 operates as a typical UVR (Under Voltage Release) device.

When the input terminal T3 is in the first operating condition A, the power & control unit 3 thus feeds the electromagnet 2 in such a way that the plunger 8 is magnetically actuated from the non-excited position to the excited position in response to transitions of the input voltage VIN across predefined threshold voltages.

More particularly, as shown in FIGS. 7, 7A-7B, when the input terminal T3 is in the first operating condition A, the power & control unit 3 operates as follows.

Let the input voltage VIN show a transition from a value lower than the first threshold voltage VTH1 to a value higher than said first threshold voltage at the instant t1.

In response to said transition of the input voltage VIN, the power & control unit 3 provides a launch pulse of drive current IC to the electromagnet 2, which has a predetermined launch level IL and a launch time TL.

In this way, a quick and high energization of the electromagnet 2 to magnetically actuate the plunger 8 is obtained.

After having provided said launch pulse, at the instant t1+TL, the power & control unit 3 reduces the drive current IC to a predetermined hold level IH lower (e.g. even 10 times lower) than the launch level IL and maintains the drive current IC at the hold level IH until the input voltage VIN remains higher than a second threshold voltage VTH2, which is lower or equal than the first threshold voltage VTH1.

From the above, it is evident how, when the input voltage VIN becomes higher than the threshold voltage VTH1, the power & control unit 3 drives the electromagnet 2 in such a way that the plunger 8 performs a "launch and hold" movement (in opposition to the biasing force exerted by the elastic element 9), i.e. the plunger 8 is moved from the non-excited position to the excited position and is maintained in this latter position until the input voltage VIN remains higher than the threshold voltage VTH2.

Referring again to FIGS. 7A-7B, at the instant t2, the input voltage VIN is now supposed to show a transition from a value higher than the second threshold voltage VTH2 to a value lower than said second threshold voltage.

In response to said transition of the input voltage VIN, the power & control unit interrupts the drive current IC flowing to the electromagnet 2.

In this way, the de-energization of the electromagnet 2 is obtained and no magnetic fields are generated anymore.

The plunger 8 performs a "release" movement upon an actuation force exerted by the elastic element 9, i.e. it is moved from the excited position to the non-excited position and it stably remains in this latter position until the input voltage VIN remains lower than the threshold voltage VTH1.

Preferably, the second threshold voltage VTH2 is lower than the first threshold voltage VTH1. The behavior of the power & control unit 3, in this case, is schematically shown in FIG. 7A.

However, the first and second threshold voltages VTH1, VTH2 may coincide. The behavior of the power & control unit 3, in this case, is schematically shown in FIG. 7B. As it is possible to notice, the behavior of the power & control unit 3 is basically the same for both the mentioned cases.

According to alternative embodiments of the invention (not shown), when the input terminal T3 is in the first operating condition A, the power & control unit may drive the electromagnet 2 in such a way the coil actuator 1 operates differently from the above, e.g. as a PSSOR (Permanent Supply Shunt Opening Release) device.

In this cases, when the input terminal T3 is in the first operating condition A, the power & control unit 3 still drives the electromagnet 2 depending on the input voltage VIN applied at the input terminals T1, T2 but it implements a different way of controlling the movements of the plunger 8 with respect to the UVR control logic described above.

According to an embodiment of the invention, which is shown in the cited figures, when the input terminal T3 is in the second operating condition B, the power & control unit 3 do not provide drive currents to the electromagnet 2 independently from the input voltage VIN applied at the input terminals T1, T2 (FIG. 6).

In practice, when the input terminal T3 is the second operating condition B, the electromagnet 2 is forced to be or remain de-energized and the plunger 8 is forced to move to or remain in the non-excited position, independently from the input voltage VIN.

The operation of the coil actuator 1, when the input terminal T3 reversibly switches between the first and second operating conditions A, B, is now briefly described.

When the input terminal T3 switches from the first operating condition A to the second operating condition B at a given instant, the power & control unit 3 stops controlling the electromagnet 2 in accordance with the normal control conditions NDC and starts controlling the electromagnet 2 in accordance with the overriding control conditions ODC (FIGS. 6-7).

Supposing that the power & control unit 3 implements an UVR control logic when controlling the electromagnet 2 in accordance to the normal control conditions NDC, we have that:

- if the power & control unit 3 is providing a drive current IC to the electromagnet 2 at said given instant, said drive current is interrupted, the electromagnet 2 is de-energized and the plunger 8 is forced to move from the excited position to the non-excited position ("release" movement) and remains in this latter position until the input terminal T3 remains the first operating condition B; or
- if the power & control unit 3 is not providing a drive current IC to the electromagnet 2 at said given instant, the electromagnet 2 is maintained de-energized and the plunger 8 remains in the non-excited position until the input terminal T3 remains the first operating condition B.

When the input terminal T3 switches from the second operating condition B to the first operating condition A at a given instant, the power & control unit 3 stops controlling the electromagnet 2 in accordance with the overriding control conditions ODC and starts controlling the electromagnet 2 in accordance with the normal control conditions NDC (FIGS. 6-7).

Supposing that the power & control unit 3 implements an UVR control logic when controlling the electromagnet 2 in accordance to the normal control conditions NDC, we have that:

- if the input voltage VIN is higher than the threshold value VTH1 at said given instant, the electromagnet 2 is energized and the plunger 8 is forced to move from the non-excited position to the excited position and remains in this latter position until the voltage VIN remains higher than the threshold value VTH2 ("launch and hold" movement); or
- if the input voltage VIN is lower than the threshold value VTH1 at said given instant, the electromagnet 2 is maintained de-energized and the plunger 8 remains in the non-excited position until the voltage VIN remains lower than the threshold value VTH1.

Again, it is evidenced that the described behavior of the power & control unit 3 is basically the same in the cases in which the threshold voltages VTH1, VTH2 are different or coincide.

According to an embodiment of the invention, which is shown in the cited figures, the power & control unit 3 comprises a cascade of electronic stages, namely an input stage 4, a control stage 5 and a drive stage 6.

Preferably, the input stage 4 is electrically connected with the input terminals T1, T2 and is adapted to receive the input voltage VIN between the terminals T1, T2 and provide a rectified voltage VR, the behavior of which depends of the input voltage VIN.

Preferably, the control stage 5 is operatively connected with the input stage 4 and the input terminal T3.

Preferably, the control stage 5 is adapted to receive the rectified voltage VR from the input stage 4 and provide control signals C to control the operation of the electromagnet 2.

As it will be more apparent from the following, the control stage 5 is adapted to provide the control signals C depending on the operating conditions A, B of the input terminal T3 and, possibly (i.e. only when the terminal T3 is in the first operating condition A), depending on the rectified voltage VR, which in turn depends on the input voltage VIN.

Preferably, the drive stage 6 is operatively connected with the control stage 5 and the electromagnet 2, in particular with the actuation coil 2A of this latter.

Preferably, the drive stage 6 is adapted to receive the control signals C from the control stage 5 and adjust the flow of a drive current IC supplied to said electromagnet in response to said control signals.

Preferably, the power & control unit 3 comprises a feeding stage 7 operatively connected with the input stage 4, the control stage 5, the drive stage 6 and the coil electromagnet 2.

Preferably, the feeding stage 7 is adapted to receive the rectified voltage VR and provide the electric power needed for the operation of the power & control unit 3 (namely the electronic stages 4, 5, 6) and the electromagnet 2.

Figure 4:
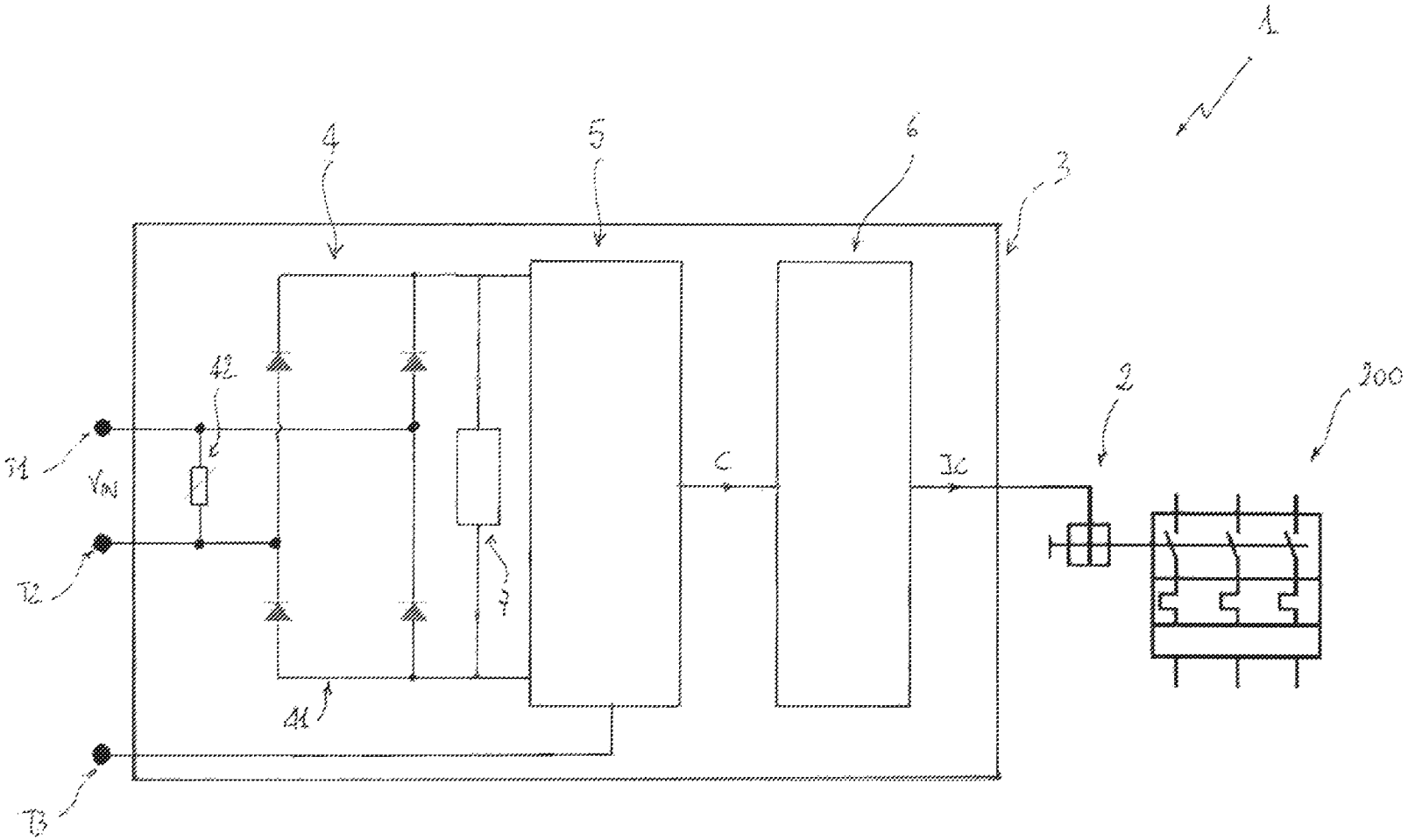
FIGS. 4, 5, 5A, 5B, 5C, 5D illustrate schematic views of a power & control unit on board the coil actuator of FIGS. 1-3.

Referring to an embodiment shown in the cited figures, the input stage 4 preferably comprises a rectifying circuit 41 that may include a diode bridge suitably arranged according to configurations known to the skilled person (FIG. 4).

The input stage 4 may also comprise one or more filtering or protection circuits 42 suitably arranged according to configurations known to the skilled person.

Referring to an embodiment shown in the cited figures, the control stage 5 preferably comprises a detection circuit 51 and a control circuit 52 electrically connected in cascade.

The detection circuit 51 is operatively connected with the input stage 4 and the input terminal T3 and is adapted to receive the rectified voltage VR.

The detection circuit 51 is adapted to provide first detection signals S, which are indicative of the rectified voltage VR and therefore of the input voltage VIN, or overriding signals OS, which have a predefined value, depending on the operating condition A, B of the input terminal T3.

More particularly, the detection circuit 51 is adapted to provide first detection signals S indicative of the rectified voltage VR, when the input terminal T3 is in the first operating condition A, and overriding signals OS having a predefined value, when the input terminal T3 is in the second operating condition B.

Preferably, both the detection signals S and the overriding signals OS are voltage signals. The behavior of the detection signals S basically depends on the behavior of the applied voltage VIN whereas the overriding signals OS have a predefined value, preferably at a "low" logic level (e.g. around 0V).

Preferably, the detection circuit 51 comprises a first circuit section 511 operatively connected between the input stage 4 and the control circuit 52.

The first circuit section 511 is adapted to receive the rectified voltage VR and provide the detection signals S, when the input terminal T3 is in the first operating condition A.

Preferably, the circuit section 511 comprises a resistive divider electrically connected with an output 40 of the input stage 4 and a first input node 52A of the control circuit 52.

The circuit section 511 may also comprise one or more filtering circuit arrangements (not shown) suitably designed according to configurations known to the skilled person.

Preferably, the detection circuit 51 comprises a second circuit section 512 operatively connected between the input terminal T3, the circuit section 511 and the control circuit 5.

The second circuit section 512 is adapted to prevent the first circuit section from providing the detection signals S to the control circuit 52 when the input terminal T3 is in the second operating condition B.

The circuit section 512 is further adapted to provide the overriding signals OS to the control circuit 5 in substitution of the detection signals S, when the input terminal T3 is in the second operating condition B.

Preferably, the circuit section 512 comprises a RC circuit arrangement operatively connected among the input node 52A of the control circuit 52, the input terminal T3 and ground. Such a RC circuit arrangement may include, for example, a capacitor 513 and a resistor 514 mutually connected in parallel between the input node 52A and the ground. The input node 52A is in turn electrically connected also with the terminal T3 and the circuit section 511.

When the input terminal T3 is in the first operating condition A (FIG. 7), according to which it is electrically floating, a charging current I1 can flow from the circuit section 511 to the ground passing through the circuit section 512, in particular the capacitor 513. The charging current I1 is generated by a detection signal S (having given voltage values) indicative of the rectified voltage VR received by the first circuit section 511.

The charging current I1 charges the capacitor 513 that is progressively brought to a voltage imposed by the circuit section 511 (i.e. about the voltage values of the signal S) according to a suitably calculated charging time constant.

The circuit section 511 can thus provide the detection signals S to the control circuit 52 without any interference by the circuit section 512.

When the input terminal T3 is in the second operating condition B (FIG. 6), according to which it is electrically connected with the terminal T2, a discharging current I2 flows through the capacitor 513 towards the third terminal T3.

At it is better explained in the following, the discharging current I2 is basically directed to ground to discharge the capacitor 513 that is quickly brought to a ground voltage according to a suitably calculated discharging time constant.

By properly calculating such a discharging time constant, the output of the circuit section 511 can thus quickly short-circuited to ground and the detection signals S cannot anymore be provided to the control circuit 52, as also the input node 52A is short-circuited to ground.

An overriding signal OS having a predefined value at "low" logic level (e.g. about 0V) is thus provided to the control circuit 52, at the input node 52A, in substitution of the detection signals S.

Preferably, the circuit section 512 comprises a circuit arrangement 517 to allow the discharging current I2 to flow towards ground to discharge the capacitor 513, when the input terminal T3 is in the second operating condition B.

According to certain embodiments of the invention, when it is in the second operating condition B, the input terminal T3 is electrically connected with the input terminal T1 or T2 (as shown in the cited figures), which is intended to be put at a positive voltage.

Figure 5:
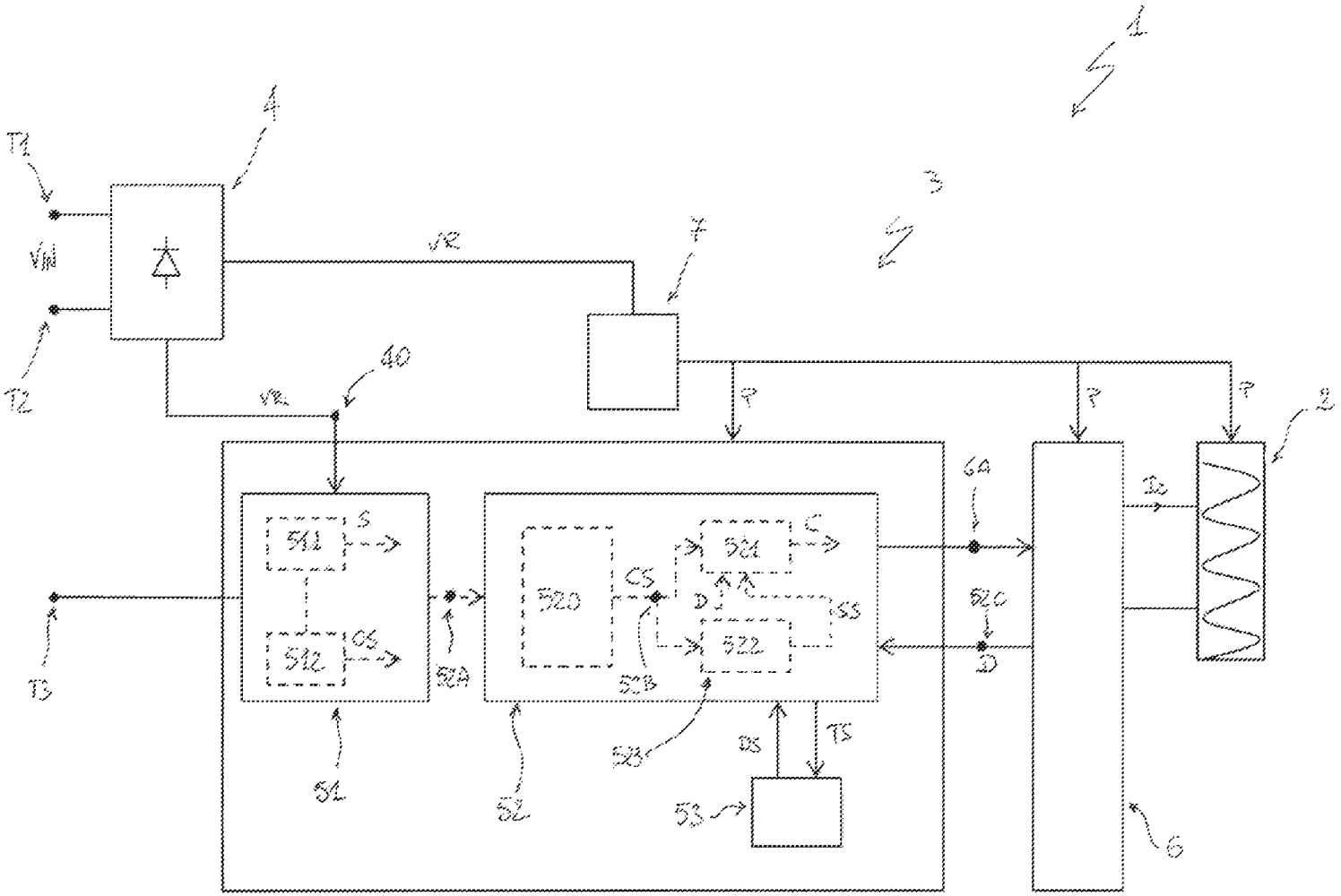
Figure 5A:
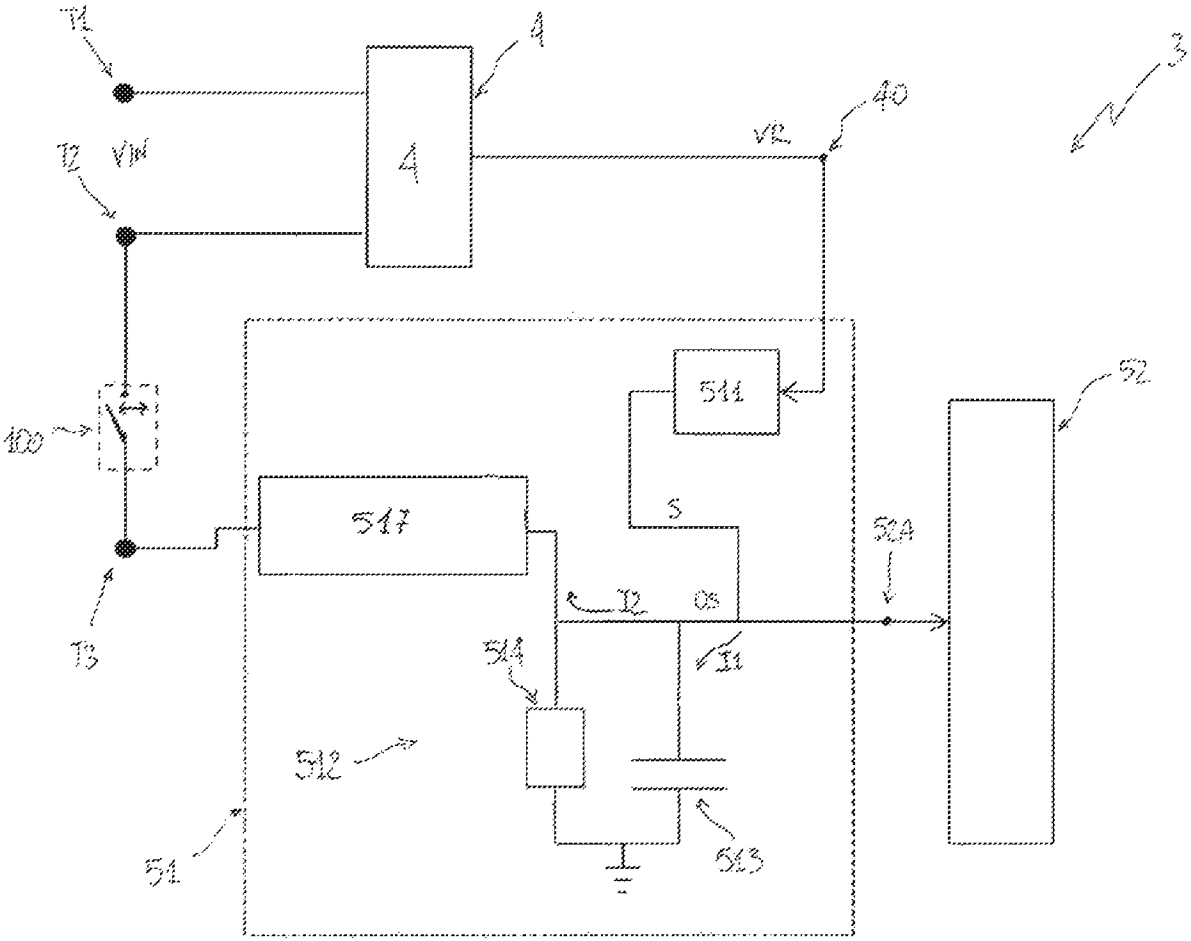
Figure 5B:
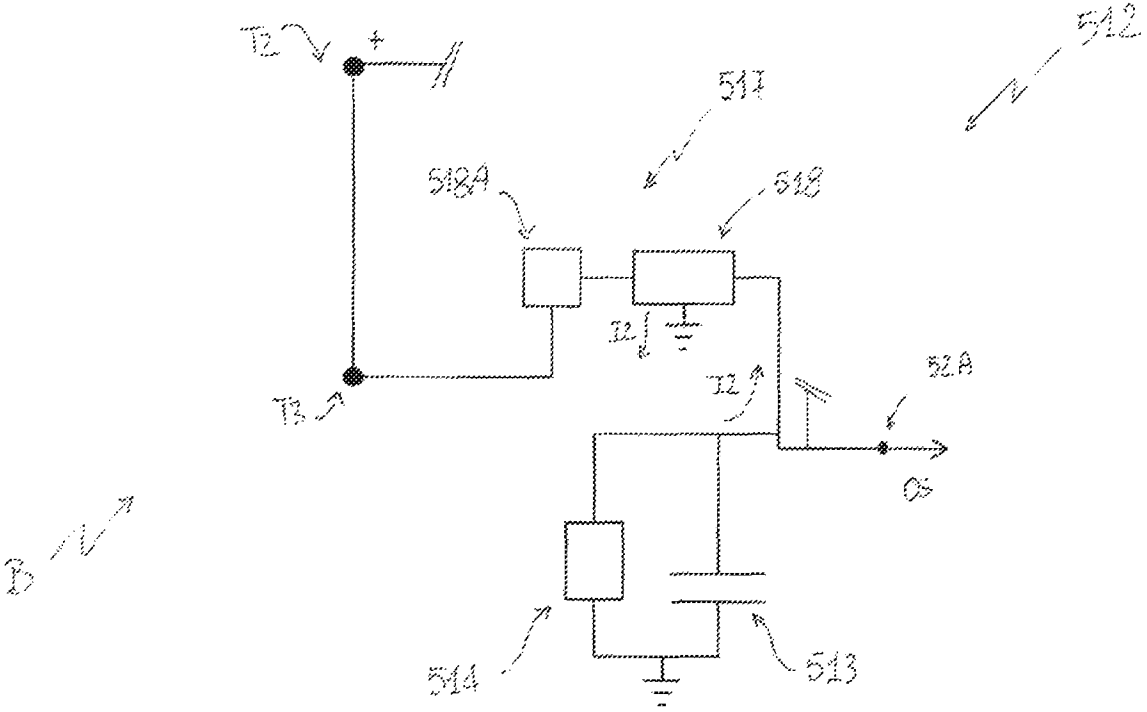

In these cases (FIG. 5B), the circuit section 517 preferably comprises a switch 518 (e.g. a MOSFET, IGBT, BJT or another equivalent device) and a resistive network 518A, which are suitably configured to allow the passage of the discharging current I2 directed towards ground to discharge the capacitor 513, when the input terminal T3 is in the second operating condition B.

The switch 518 may be configured in such a way to switch in conduction state (ON), when the input terminal T3 is in the second operating condition B and it takes positive voltage values, as it is electrically connected with the input terminal T2. In this way, the switch 518 provides a conductive path towards ground for the discharging current I2.

According to other embodiments of the invention, when it is in the second operating condition B, the input terminal T3 is electrically connected with the input terminal T1 or T2 (as shown in the cited figures), which is intended to be grounded or put at a negative voltage.

Figure 5C:
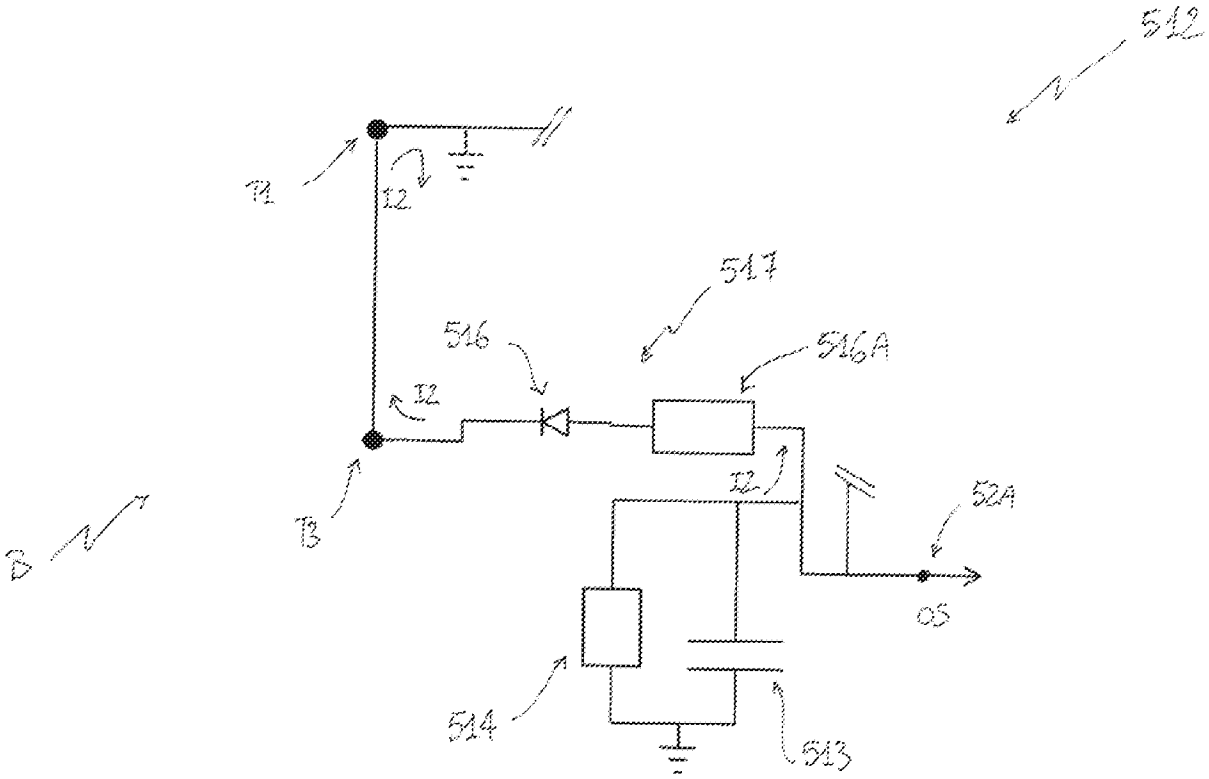

In these cases (FIG. 5C), the circuit section 517 preferably comprises a diode 516 and resistive network 516A suitably configured to allow the passage of the current I2 through the terminal T3 towards ground to discharge the capacitor 513, when the input terminal T3 is in the second operating condition B.

The diode 516 may be configured in such a way to switch in conduction state (ON), when the input terminal T3 is in the second operating condition B and it takes a negative or ground voltage, as it is electrically connected with the input terminal T2. In this way, the diode 516 provides a conductive path (passing through the terminals T2, T3 in the embodiment shown in the cited figures) towards ground for the discharging current I2.

Further variants for the circuit arrangement 517 are possible depending on the input terminal T1 or T2 to which the input terminal T3 is electrically connected, when it is in the second operating condition B, and depending on the operative voltages intended for such input terminal T1 or T2.

Preferably, the control circuit 52 comprises a comparison section 520 operatively connected in cascade with the detection circuit 51.

The comparison section 520 is adapted to receive the detection signals S or the overriding signals OS and provide comparison signals CS in response to said detection signals or said overriding signals.

Preferably, the comparison section 520 comprises a comparator circuit arrangement operatively connected between among the input node 52A and an intermediate node 52B of the control circuit 52 and suitably designed according to configurations known to the skilled person.

Preferably, the comparison signals CS provided by the comparison section 520 are voltage signals that may be at "high" or "low" logic levels depending on the input voltage signals S or OS.

Preferably, when it receives the detection signals S or the overriding signals OS, the comparison section 520 compares these input signals with predefined comparison values, which may be equal or proportional to the threshold voltages VTH1, VTH2.

Preferably, such a predefined comparison value is provided by a dedicated circuit suitably arranged in the comparison section 520 according to configurations known to the skilled person.

Preferably, when it receives the detection signals S, the comparison section 520 provides comparison signals CS at high" or "low" logic levels depending on whether the detection signals S are lower or higher than said predefined comparison values, which event in turn depends on the behavior of the applied input voltage VIN.

Preferably, when it receives the overriding signals OS, the comparison section 520 provides comparison signals CS at a "low" logic level only, as the overriding signals OS has a predefined value at a "low" logic level, which is certainly lower than said predefined comparison values.

In practice, the comparison signals CS are provided at a predefined "low" logic level when the overriding signals OS are received by the comparison section 520 (i.e. when the input terminal T3 is in the second operative condition B).

Preferably, the control circuit 52 comprises a control section 523 operatively connected between the comparison section 520 (in particular the intermediate node 52B) and the drive stage 6 (in particular an input 6A of this latter).

The control section 523 is adapted to receive the comparison signals CS and provide the control signals C to the drive stage 6 in response to the comparison signals CS.

Preferably, the control section 523 is adapted to receive second detection signals D from the drive stage 6 at a second input node 52C of the control circuit 52.

Preferably, the detection signals D are indicative of the drive current IC provided by the power & control unit 3 to the electromagnet 2.

Advantageously, the control section 523 may comprise one or more controllers, e.g. microcontrollers or digital processing devices of different type, adapted to receive and provide a number of analog and/or digital inputs and comprising re-writable non-volatile memory areas that can be used to store executable software instructions or operating parameters.

Preferably, the control section 523 comprises a first controller 521 operatively connected between the comparison section 520 (in particular the intermediate node 52B) and the drive stage 6 (in particular the input node 6A).

The first controller 521 is adapted to receive the comparison signals CS and the detection signals D and provide the control signals C in response to said input signals.

In this way, the controller 521 is capable of controlling the drive stage 6 to properly energize or de-energize the electromagnet 2 according to the needs, i.e. depending on the operating conditions A, B of the input terminal T3 and, possibly (i.e. only when the terminal T3 is in the first operating condition A) depending on the applied voltage VIN.

Preferably, the controller 521 is configured to provide control signals C to provide no drive currents IC to the electromagnet 2, when the comparison signals CS are at a "low" logic level. Preferably, the controller 521 is configured to provide control signals C to provide a drive current IC having values set according to a given profile, e.g. the profiles shown in FIGS. 7A-7B, when the comparison signals CS are at a "high" logic level.

Preferably, the controller 521 is a PWM controller that is capable to control the drive stage 6 to basically perform a duty-cycle modulation of the drive current IC, which may be adjusted according to given setting parameters.

Preferably, the control section 523 comprises a second controller 522 operatively connected with the first controller 521.

The controller 522 is preferably adapted to provide setting signals SS for controlling the drive current IC, which are received and processed by the first controller 521 to provide the control signals C.

As an example, in order to provide a drive current IC having the profiles shown in FIGS. 7A-7B to the coil electromagnet 2, the controller 522 may initially provide setting signals SS indicative of the desired launch level IL and launch time TL to the controller 521. In this way, a suitable adjustment of the drive current IC is obtained, when the electromagnet 2 starts to be energized. Then, the controller 522 may provide setting signals SS indicative of a current reference value (e.g. the desired hold level IH) to be adopted by the controller 521 to perform a PWM adjustment of the drive current IC, when the electromagnet 2 has to be maintained energized.

Preferably, the controller 522 is operatively connected with the comparison section 520 to receive and process the comparison signals CS and provide the setting signals SS depending on said comparison signals.

Preferably, the control stage 5 comprises a disabling circuit 53 operatively connected with the control circuit 52.

The disabling circuit 53 is adapted to prevent the control circuit 52 from providing control signals C to supply a launch pulse of drive current IC to the electromagnet 2 for a given period of time starting from the instant in which a preceding launch pulse of drive current IC has been supplied to said electromagnet.

As an example, launch pulses of drive current IC may be provided by the power & control unit 3 to the electromagnet 2 when the plunger 8 has to be moved from the non-excited position to the excited position, e.g. to perform a "launch and hold" movement.

Preferably, the disabling circuit 53 is operatively connected with the second controller 522 and receives temporization signals TS from this latter, when a launch pulse of drive current IC is generated.

In response to the temporization signals TS, the disabling circuit 53 provides disabling signals DS to the controller 522 for a given period of time starting from the instant in which the launch pulse of drive current IC is supplied to the electromagnet 2.

Preferably, in response to the received disabling signals DS, the second controller 522 provides setting signals SS to the first controller 521 in order to prevent the generation of a new launch pulse of drive current IC.

The disabling circuit 53 is particularly useful when the applied input voltage VIN is instable for some reasons and the power & control unit 3 is somehow forced to drive the electromagnet 2 in such a way that the plunger 8 performs multiple subsequent "launch and hold" and "release" movements due to fluctuations of the applied input voltage VIN.

As the disabling circuit 53 is adapted to ensure that subsequent launch pulses of drive current IC are separated by a given time interval, over-heating phenomena of the electromagnet 2 and excessively close current adsorption peaks by the coil electromagnet 1 are avoided or mitigated.

Figure 5D:
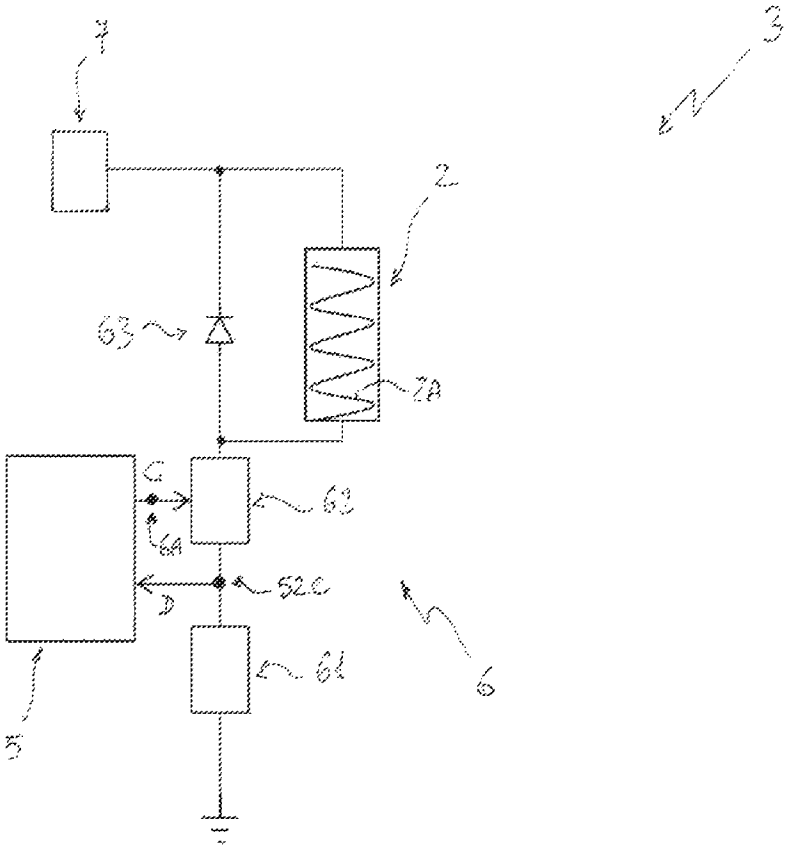

Referring to an embodiment shown in the cited figures, the drive stage 6 preferably comprises a shunt resistor 61 and a switch 62 electrically connected in series between the ground and the actuation coil 2A of the electromagnet 2, which is in turn electrically connected with the feeding stage 7 to receive electric power P (FIG. 5D).

In this way, a drive current IC, which can be properly adjusted by the switch 62, can flow through the actuation coil 2A, the switch 62 and the shunt resistor 61 during the operation of the coil actuator 1.

Preferably, the switch 62 is operatively connected with the control stage 5, in particular with the control circuit 53, to receive the control signals C and adjust the drive current IC depending on said control signals.

As an example, the switch 62 may be a MOSFET having the gate terminal electrically connected with the input node 6A to receive the (voltage) control signals C, the drain terminal electrically connected in series with the actuation coil 2A and the source terminal electrically connected with the input node 52C.

However, the switch 62 may be also an IGBT, a BJT or another equivalent device.

Preferably, the shunt resistor 61 is electrically connected between the ground and the input node 52C is such a way to provide voltage signals D indicative of the drive current IC flowing towards the ground at the input node 52C.

Preferably, the drive stage 6 comprises a free-wheeling diode 63 electrically connected in series with the feeding stage 6 and the switch 62 and in parallel with the actuation coil 62.

From the above, it is apparent how the drive stage 6 is capable of controlling the flow of a drive current IC through the actuation coil 2A.

The values of the drive current IC can be adjusted by the switch 62 depending on the operating status thereof, which in turn depends on the control signals C.

As an example, the switch 62 may receive control signals C to switch in interdiction state (OFF) in such a way to interrupt the flow of the drive current IC through the actuation coil 2A.

As a further example, the switch 62 may receive control signals C to switch in conduction state (ON) and modulate the flow of the drive current IC depending on said control signals, e.g. by implementing a PWM control of the drive current IC.

It has been shown in practice how the coil actuator 1, according to the present invention, fully achieves the intended aim and objects.

Thanks to the presence of the third terminal T3, the coil actuator 1 shows improved performances with respect to corresponding devices of the state of the art.

The operating status of the coil actuator can in fact be controlled independently from the values of the applied input voltage VIN, particularly when a "release" movement of the movable plunger is needed.

The coil actuator 1 shows therefore different operation modes, which may be easily selected by properly switch the terminal T3.

Such a flexibility in operation makes the coil actuator 1 quite suitable for integration in LV or MV switchgears.

The coil actuator has a very compact structure, which may be industrially realized at competitive costs with respect to traditional devices of the state of the art.

The coil actuator, according to the invention, thus conceived may undergo numerous modifications and variants, all coming within the scope of the inventive concept. Moreover, all the component parts described herein may be substituted by other, technically equivalent elements. In practice, the component materials and dimensions of the device may be of any nature, according to needs.

The invention claimed is:

1. A coil actuator for low and medium voltage applications comprising:

an electromagnet operatively associated with a movable plunger to actuate said movable plunger;

a power & control unit electrically connected with said electromagnet to feed said electromagnet and control the operation of said electromagnet;

first and second input terminals (T1, T2) electrically connected with said power & control unit, wherein an input voltage (VIN) is applied between said first and second input terminals during the operation of said coil actuator; and a third input terminal (T3) electrically connected with said power & control unit, said third input terminal being adapted to be in a first operating condition (A) of being electrically floating, said first operating condition corresponding to normal control conditions (NDC) for the operation of said electromagnet, or in a second operating condition (B) of being electrically coupled with one of said first and second input terminals (T1, T2), said second operating condition corresponding to overriding control conditions (ODC) for the operation of said electromagnet, wherein said power & control unit is adapted to control the operation of said electromagnet according to said normal control conditions or said overriding control conditions depending on the operating condition (A, B) of said third input terminal.

2. The coil actuator according to claim 1, wherein said power & control unit is adapted to control the operation of said electromagnet depending on the input voltage (VIN) applied between said first and second input terminals (T1, T2), when said third input terminal (T3) is in said first operating condition (A).

3. The coil actuator, according to claim 2, wherein said power & control unit is adapted to control the operation of said electromagnet independently from the input voltage (VIN) applied between said first and second input terminals (T1, T2), when said third input terminal (T3) is in said second operating condition (B).

4. The coil actuator, according to claim 3, wherein said power & control unit is adapted to provide no drive currents to said electromagnet, when said third input terminal (T3) is in said second operating condition (B), independently from the input voltage (VIN0 applied between said first and second input terminals (T1, T2).

5. The coil actuator according to claim 1, wherein said power & control unit is adapted to control the operation of said electromagnet independently from the input voltage (VIN) applied between said first and second input terminals (T1, T2), when said third input terminal (T3) is in said second operating condition (B).

6. The coil actuator according to claim 5, wherein said power & control unit is adapted to provide no drive currents to said electromagnet, when said third input terminal (T3) is in said second operating condition (B), independently from the input voltage (VIN) applied between said first and second input terminals (T1, T2).

7. The coil actuator according to claim 1, wherein said power & control unit comprises:

an input stage electrically connected with said first and second input terminals (T1, T2) wherein said input stage is adapted to receive said input voltage (VIN) and provide a rectified voltage (VR) obtained by rectifying said input voltage;

a control stage operatively connected with said input stage and said third input terminal (T3), wherein said control stage is adapted to receive said rectified voltage (VR) and provide control signals (C) to control the operation of said electromagnet;

a drive stage operatively connected with said control stage and said electromagnet, wherein said drive stage is adapted to receive said control signals (C) from said control stage and adjust the flow of a drive current (IC) to said electromagnet in response to said control signals.

8. The coil actuator according to claim 7, wherein said control stage comprises a detection circuit operatively connected with said input stage and said third input terminal (T3), wherein said detection circuit is adapted to receive said rectified voltage (VR) and provide first detection signals (S) indicative of said rectified voltage or overriding signals (OS) having a predefined value, depending on the operating condition (A, B) of said third input terminal.

9. The coil actuator according to claim 8, wherein said detection circuit comprises:

a first circuit section adapted to receive said rectified voltage (VR) and provide said first detection signals (S), when said third input terminal (T3) is in said first operating condition (A);

a second circuit section adapted to provide said overriding signals (OS) in substitution of said first detection signals (S), when said third input terminal (T3) is in said second operating condition (B).

10. The coil actuator, according to claim 9, wherein said control stage comprises a control circuit operatively connected with said detection circuit and said drive stage, wherein said control circuit is adapted to receive said first detection signals (S) or said overriding signals (OS) and provide said control signals (C) to said drive stage in response to said first detection signals or said overriding signals.

11. The coil actuator, according to claim 10, wherein said control circuit comprises: a comparison section adapted to receive said first detection signals (S) or said overriding signals and provide comparison signals (CS) in response to said first detection signals or said overriding signals (OS); and a control section adapted to receive said comparison signals (CS) and provide said control signals (C) to said drive stage in response to said comparison signals.

12. The coil actuator according to claim 8, wherein said control stage comprises a control circuit operatively connected with said detection circuit and said drive stage, wherein said control circuit is adapted to receive said first detection signals (S) or said overriding signals (OS) and provide said control signals (C) to said drive stage in response to said first detection signals or said overriding signals.

13. The coil actuator according to claim 12, wherein said control circuit comprises:

a comparison section adapted to receive said first detection signals (S) or said overriding signals and provide comparison signals (CS) in response to said first detection signals (S) or said overriding signals (OS);

a control section adapted to receive said comparison signals (CS) and provide said control signals (C) to said drive stage in response to said comparison signals.

14. The coil actuator, according claim 13 wherein said control stage comprises a disabling circuit operatively connected with said control circuit, wherein said disabling circuit is adapted to prevent said control circuit from providing control signals (C) to supply a launch pulse of drive current (IC) to said electromagnet for a given period of time starting from the instant in which a preceding launch pulse of drive current (IC) is supplied to said electromagnet.

15. The coil actuator according claim 12, wherein said control stage comprises a disabling circuit operatively connected with said control circuit, wherein said disabling circuit is adapted to prevent said control circuit from providing control signals (C) to supply a launch pulse of drive current (IC) to said electromagnet for a given period of time starting from the instant in which a preceding launch pulse of drive current (IC) is supplied to said electromagnet.

16. The coil actuator according to claim 1, wherein said electromagnet comprises a single actuation coil (2A).

17. A low and medium voltage switching apparatus or switchgear characterised in that it comprises a coil actuator, claim 1.

18. A coil actuator for low and medium voltage applications comprising:

an electromagnet operatively associated with a movable plunger to actuate said movable plunger;

first and second input terminals (T1, T2) wherein an input voltage (VIN) is applied between said first and second input terminals during the operation of said coil actuator;

a third input terminal (T3) said third input terminal being adapted to be in a first operating condition (A), which corresponds to normal control conditions (NDC) for the operation of said electromagnet, or in a second operating condition (B), which corresponds to overriding control conditions (ODC) for the operation of said electromagnet; and a power & control unit electrically connected with said electromagnet to feed said electromagnet and control the operation of said electromagnet, the power & control unit including:

an input stage electrically connected with said first and second input terminals (T1, T2) wherein said input stage is adapted to receive said input voltage (VIN) and provide a rectified voltage (VR) obtained by rectifying said input voltage, and a control stage including a detection circuit operatively connected with said input stage and said third input terminal (T3), wherein said detection circuit is adapted to receive said rectified voltage (VR) and provide first detection signals (S) indicative of said rectified voltage or overriding signals (OS) having a predefined value, depending on the operating condition (A, B) of said third input terminal.

19. The coil actuator of claim 18, wherein the control stage is adapted to provide control signals (C) to control the operation of said electromagnet, herein the power & control unit includes a drive stage operatively connected with said control stage and said electromagnet, and wherein said drive stage is adapted to receive said control signals (C) from said control stage and adjust the flow of a drive current (IC) to said electromagnet in response to said control signals.

20. The coil actuator according to claim 19, wherein said control stage comprises a control circuit operatively connected with said detection circuit and said drive stage, wherein said control circuit is adapted to receive said first detection signals (S) or said overriding signals (OS) and provide said control signals (C) to said drive stage in response to said first detection signals or said overriding signals.

* * * * *